United States Patent [19]

Marchetti

[11] Patent Number: 4,507,108

[45] Date of Patent: Mar. 26, 1985

[54] DEVICE FOR THE CONTROL OF THE MUTUAL REMOVAL AND APPROCHING MOVEMENT OF LATERAL CONVEYING UNITS IN A CARTON SEALING AND/OR CLOSING MACHINE

[76] Inventor: Augusto Marchetti, Piazza Sicilia, 7, 20146 Milano, Italy

[21] Appl. No.: 442,031

[22] Filed: Nov. 16, 1982

[30] Foreign Application Priority Data

Jan. 26, 1982 [IT] Italy ..... 19288 A/82

[51] Int. Cl.[3] ..... B31B 1/44

[52] U.S. Cl. ..... 493/167; 493/183; 493/457

[58] Field of Search ..... 493/141, 167, 183, 347, 493/382, 453, 457; 53/374

[56] References Cited

U.S. PATENT DOCUMENTS

| | | | |
|---|---|---|---|
| 3,505,774 | 4/1970 | Gidge | 53/376 |
| 3,673,928 | 7/1972 | Striplin | 493/167 |
| 3,800,681 | 4/1974 | Corderoy | 493/167 |
| 3,977,306 | 8/1976 | Flynn | 493/141 |
| 4,041,675 | 4/1977 | Loveland | 53/374 |
| 4,262,468 | 4/1981 | Marchette | 53/374 |

*Primary Examiner*—Leon Gilden

*Attorney, Agent, or Firm*—McAulay, Fields, Fisher, Goldstein & Nissen

[57] ABSTRACT

A sliding plunger with rack-shaped opposite sides controls opposite rotations of a pair of rotating sector gears, with which integrally rotate two arms extending up to the proximity of the conveying units. Connecting rods are finally interposed between said arms and said conveying units to transform the rotary motion of the arms into a corresponding translatory motion of said conveying units in opposite senses along fixed rectilinear guides transversally disposed with respect to the carton support base. The control of the sliding of the rack plunger can be given by a pneumatic cylinder or by a hand-control lever. There can be provided adjustable means for limiting the sliding plunger stroke in the sense corresponding to the mutual removal of the conveying units and elastical thrust means acting on the same plunger in the opposite sense. The connecting rods moreover can be provided with a succession of holes, which can be alternatively chosen to change the distance among their points of pivotment with the rotating arms and the conveying units.

8 Claims, 5 Drawing Figures

DEVICE FOR THE CONTROL OF THE MUTUAL REMOVAL AND APPROCHING MOVEMENT OF LATERAL CONVEYING UNITS IN A CARTON SEALING AND/OR CLOSING MACHINE

The present invention relates to a device for the control of the mutual removal and approaching movement of lateral conveying units in a carton sealing and/or closing machine.

There are well known those carton sealing and/or closing machines, which for the carton advancement from one end of a support base to the other include a pair of conveying units disposed at the two sides of the base and approachable each other, when required, in order to realize a conveying engagement with the carton sides. Said units are usually constituted by closed-loop conveyor belts, which are rotated and guided by respective successions of pulleys rotatably supported by supports removable and approachable each other transversally to the carton advancement direction on the base.

For the transversal movement of said conveying units, in the past, various systems have been thought up, whose problem has been to assure the absolute movement equality of the two units for the automatic centering of the engaged cartons.

The object of the present invention is to realize a control device for said transversal movement, which is particularly simple, as well as efficient.

Another object of the present invention is then to realize a control device, which combines to the above mentioned qualities also those of a considerable adjustment capacity and versatility of use.

In view of such objects, the control device according to the invention, provided for a sealing and/or closing machine of the kind including a carton support base and, along two opposite sides, a pair of conveying units slidingly mounted on fixed transversal guides of the base so as to be approachable each other to realize a conveying engagement with the carton sides and then movable away from each other for the return to rest position, is characterized in that it comprises a rectilinearly sliding plunger with rack-shaped opposite sides, control means for the sliding of said plunger, a pair of rotating sectors gears in engagement with said rack sides of said plunger to transform the rectilinear sliding of the same plunger into opposite corresponding rotations of said sector gears, a pair of arms extending from said sector gears up to the proximity of said conveying units and integrally rotating with the same gears, and a pair of connecting rods connected to said arms and said conveying units to transform the rotating movement of said arms into a corresponding translatory motion of said conveying units in opposite senses along said guides.

The device according to the invention therefore is based on a very simple mechanism, which by means of the suitable identity of the various members arranged in pairs can be able to transform a rectilinear sliding of the rack plunger into identical and contemporaneous opposite movements approaching and removal of the conveying units.

As a function of the use provided for the conveying units and, in general, for the machine which embodies them, the rectilinear sliding of the rack plunger can be controlled in different way. Particularly, if the machine is destined to work with variable-width cartons, so that it is necessary to dispose the conveying units in a removed rest position before the introduction of a carton and then to approach them at variable distance for their engagement with the carton sides, the sliding control of the rack plunger can be assigned to a pneumatic cylinder and, if desired to avoid removal strokes of excessive extension for cartons of limited and not much variable width, there can be provided adjustable means able to limit the stroke of the rack plunger in the sense corresponding to the mutual removal of the conveying units. If the machine is destined, on the contrary, to work with cartons of substantially constant width, so that the conveying units can be disposed and kept at an adjustable fixed distance, the sliding control of the rack plunger can then be assigned to manual-operation adjustable means (for example a crank-controlled lever); in such case, in order to assure the due work pressure, it is however necessary to provide for the presence of elastic means acting on said plunger so as to give it a certain elastically resisted yieldingness in the sense corresponding to the mutual removal of the conveying units.

In both cases it can be further provided that the connecting rods between the rotating arms and the conveying units are provided with a succession of pivot holes which can be alternatively selected. In such a way it is possible to vary the distance between the points of pivotment with the arms and the conveying units and therefore, without prejudice to the length of the available stroke, the position of maximum mutual removal and that of maximum mutual approaching of the conveying units.

All these features evidently give the control device according to the invention very good qualities of adjustment capacity and versatility of use, which allow its use in machines of different destination.

The features of the present invention will be made more evident by the following detailed description of some embodiments thereof illustrated by way of non-limitative example in the enclosed drawings, in which.

Figure 1:
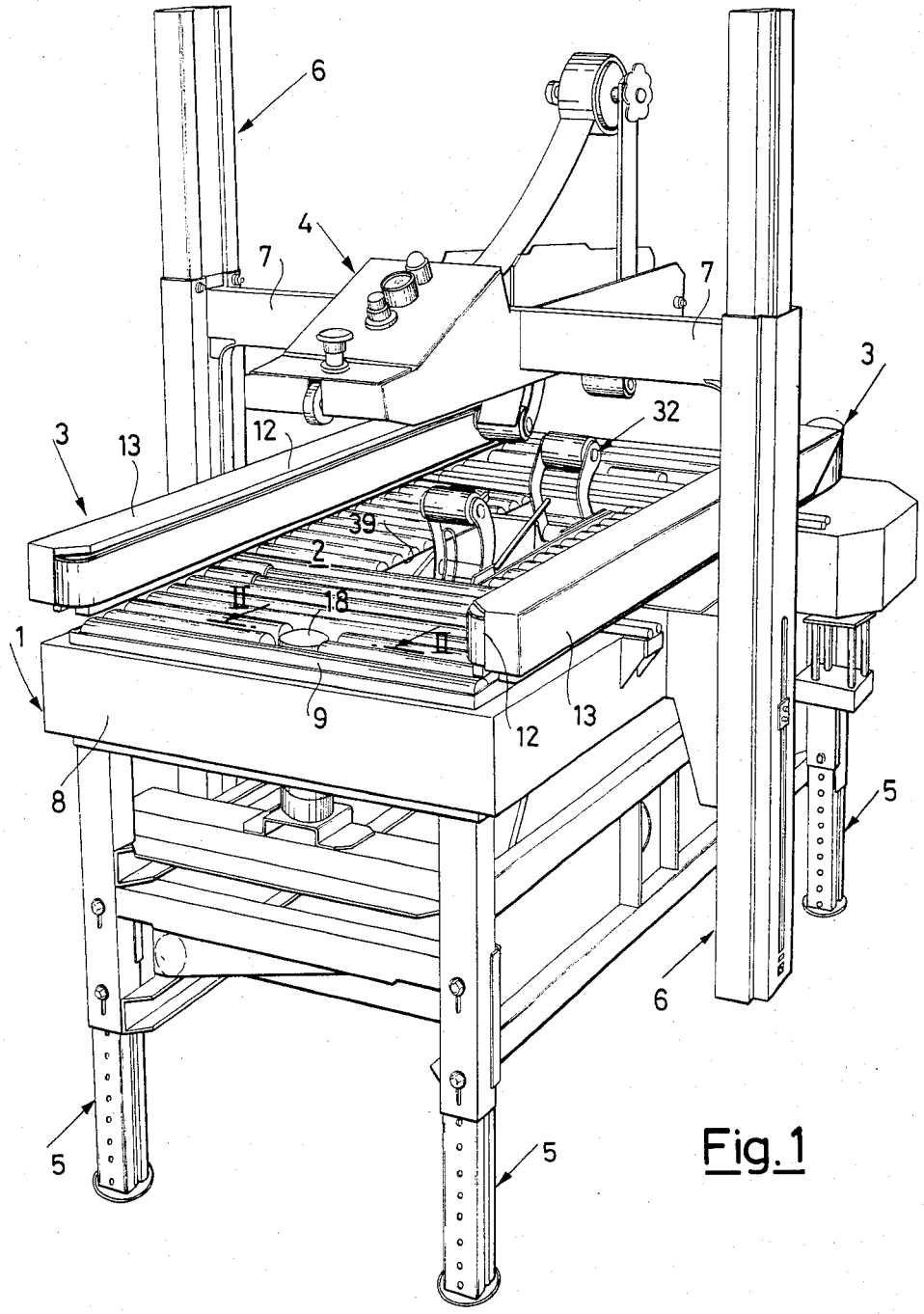
FIG. 1 shows in perspective view a sealing machine for variable-width cartons including a control device according to the invention.

With reference to FIG. 1, there is illustrated a sealing machine for variable-width cartons, which comprises, in general, a roller base 1 defining a support plane 2 for the cartons to be sealed, a pair of belt conveying units 3 disposed at the two sides of said support plane and approachable each other to engage the sides of the cartons for their rectilinear advancement from one end to the other of the support plane (from left to right, looking at FIG. 1), a lower sealing unit 32 housed in a space 39 of the base 1, and an upper sealing head or unit 4 superimposed to the support plane 2 at variable height. More precisely, the sealing head 4 is normally in a lowered rest position and is temporarily liftable from said position at each operation on a carton. Besides, there is provided a support frame which can be identified in a group of four legs 5 destined for the support of the base 1 and in a pair of columns 6 extending upwards from the base 1 for the support and the guide, through arms 7, of the sealing head 4.

Figures 3, 4:
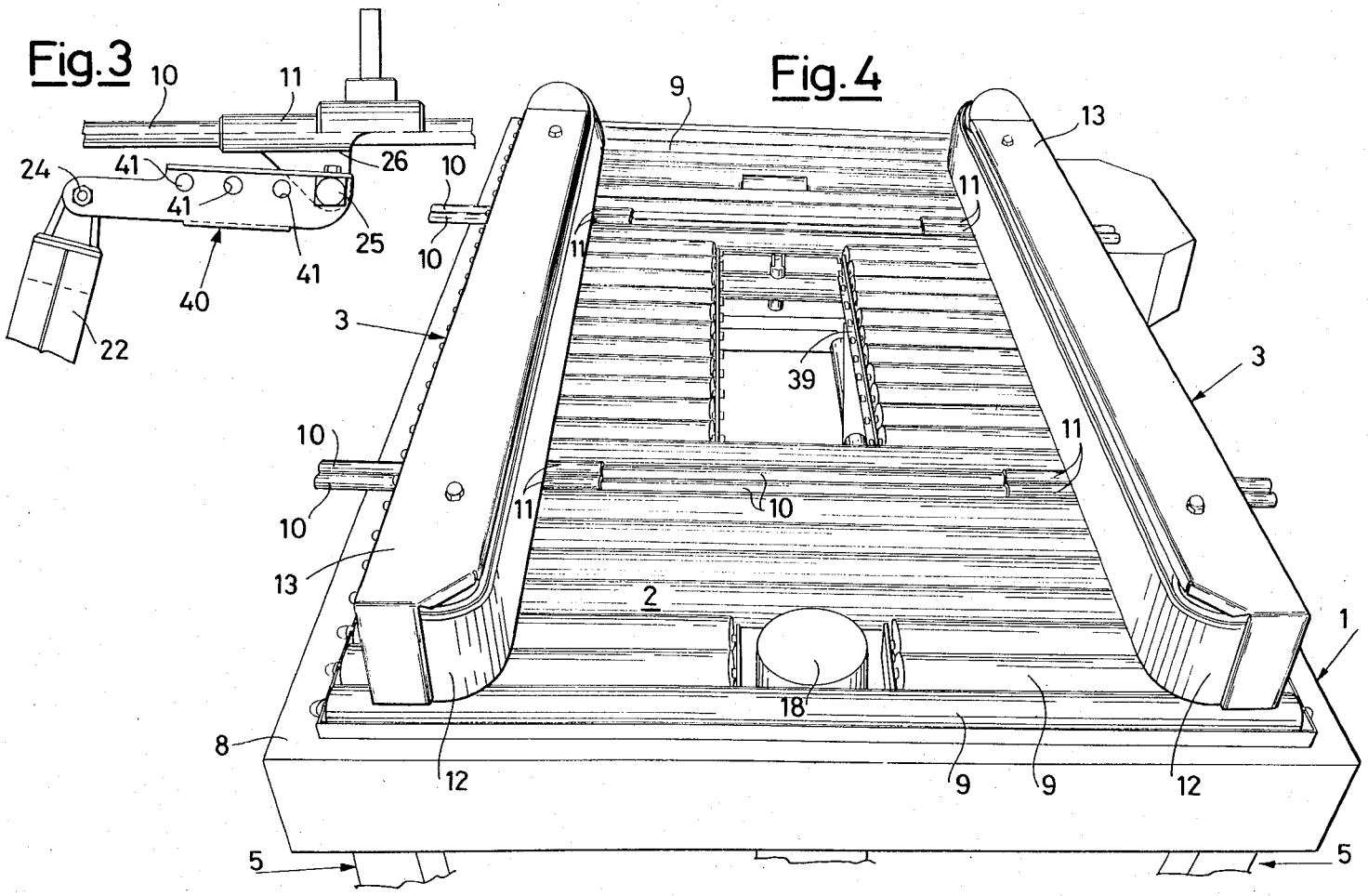
FIG. 3 shows a modified detail of the control device illustrated in FIG. 2.
FIG. 4 shows in perspective view the base of the above mentioned machine with superimposed conveying units.

The assembly constituted by the base 1 and the conveying units 3 is better illustrated in FIG. 4, where one can see that the base 1 is constituted by a rectangular frame 8 and by a succession of parallel transversal rollers 9 supported in a freely rotating way by the frame 8. Among the various rollers 9 there are also interposed two pairs of cylindrical rods 10, whose ends have no shoulder for accident prevention reasons. On each pair of cylindrical rods 10 there are slidingly mounted two pairs of sleeves 11, every one of which is destined for the support of a respective conveying unit 3.

As also shown in FIG. 1, the conveying units 3 are of the kind, known per se, constituted by closed-loop conveyor belts 12 disposed around respective successions of operation and guide pulleys 14 (FIG. 2) housed inside respective carters 13 supported by the above mentioned sliding sleeves 11. By approaching each other the two conveying units 3 beginning from the removed rest position illustrated in FIGS. 1 and 4, the conveyor belts 12 are able to engage, also in a known way, the carton sides to cause the carton advancement and therefore the passage of the same through the sealing area constituted by the upper sealing head 4 and the lower sealing unit 32.

Figure 2:
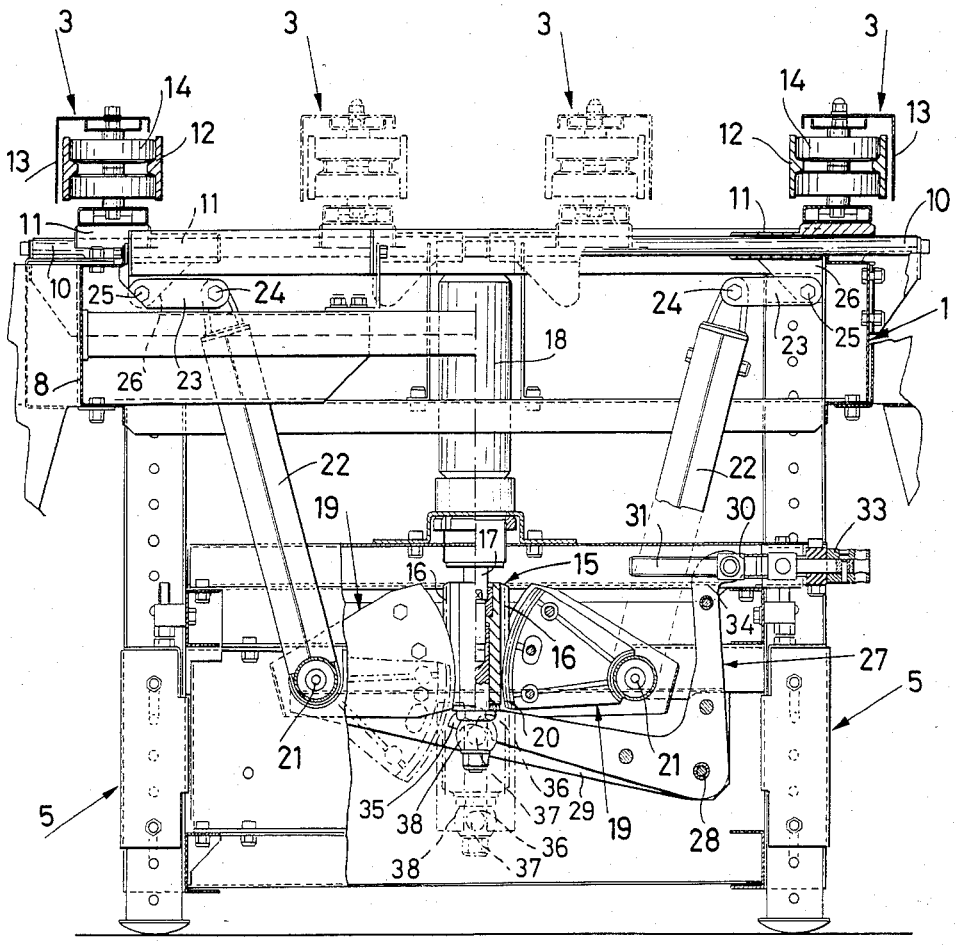
FIG. 2 shows said machine partially sectioned along a transversal plane passing through line II—II of FIG. 1.

The mutual approaching and removal transversal movement of the conveying units 3 is due to a control device, whose details are well detectable in FIG. 2. First of all, it comprises a vertically sliding plunger 15, two opposite sides of which are shaped as racks 16. For its movement control, said plunger 15 is mounted on a piston stem 17 of a standing-over pneumatic cylinder 18 opportunity fixed to the fixed frame of the machine. With the rack plunger 15 cooperate from opposite parts two rotating sector gears 19, identical and simmetrically disposed, whose teeth 20 are engaged with the respective racks 16 of the plunger 15; the rectilinear movement imparted to the plunger 15 by the cylinder 18 is thus transformed into corresponding rotary movements, identical and contemporaneous but in opposite directions, of the two sector gears 19 around the respective axes 21. With the sector gears 19 integrally rotate respective arms 22, identical and simmetrically disposed, which extend upwards up to the proximity of the sliding supports 11. The connection between the upper ends of the arms 22 and the above mentioned sliding supports 11 is finally assured by two connection rods 23, identical and simmetrically disposed, whose ends are pivoted in 24 on the arms 22 and in 25 on the brackets 26 integral with the sliding supports 11. The opposed rotations of the sector gears 19, and therefore of the arms 22, are thus transformed into corresponding opposite translatory movements of the sleeves 11 and therefore of the conveying units 3, which approach and remove each other, with identical displacements, every time the cylinder 18 controls, respectively, the lowering and the lifting of the sliding plunger 15. More precisely, beginning from the position of maximum removal illustrated in solid line in FIG. 2, the two conveying units 3 can be approached each other up to the position of maximum approaching illustrated in dash-dot line in FIG. 2. This latter position can obviously be reached according to the width of the carton laid each time on the support plane 2: if this one is wider than the minimum distance between the two conveying units, the same units will naturally stop against the carton sides, exerting on them the necessary pressure to realize the effective conveying engagement. The approached or work position of the conveying unit 3 will therefore change every time with the carton width and, in general, will be always different from the position of maximum approaching illustrated in FIG. 2.

As regards the removed or rest position of the conveying units, it is destined to correspond to that of maximum removal illustrated in FIG. 2 in the case that the cartons to be sealed, or also some of them only, are very large. It can however occur that the machine is used for a long period with limited-width cartons, in which case a good part of the removal stroke of the conveying units, more precisely its final part, would be useless and unproductive. In view of such use, the control device illustrated in FIG. 2 includes adjustable means able to set a prefixed limit to the removal stroke of the conveying units, substantiallu stopping them before they reach the position of maximum removal illustrated in FIG. 2. Said adjustable means comprise substantially a squared lever 27, which is pivoted in 28 on a bracket 29 opportunely anchored to the fixed frame of the machine. Said lever has at one end 34 a female thread 30 engaged on a threaded shaft 31 in its turn slidingly supported by the fixed frame and operable in rotation through a crank (not illustrated) coupling to a driving block 33. The other end 35 of the lever 27 includes in its turn a notch 36 engageable in the rising step by a pawl 37, which projects laterally from a spherical nut 38 made integral with the sliding plunger 15.

The end of the lever 25 therefore operates as end of stroke for the rising movement of the sliding plunger 15 and, consequently, for the mutual removal movement of the conveying units 3. By adjusting the position of the lever 27 through the rotation of the threaded shft 31, it is therefore possible to fix the rest position of the conveying units as one likes.

If desired, it can also be provided the possibility to change both the position of maximum removal and that of maximum approaching of the conveying units 3, the length of their stroke being the same. This can be obtained by replacing the connecting rods 23 with adjustable connecting rods 40, illustrated in FIG. 3, which include a succession of holes 41 which can be alternatively selected for the pivotment with the brackets 26 of the sliding supports 11. It is evident that, by moving the pin 25 from the one to the other of said holes, the two end-of-stroke positions of the conveying unit 3 correspondingly change, while the stroke length remains the one determined by the stroke of the rack plunger 15, eventually with the aid of the adjustable stop represented by the end 35 of the squared lever 27.

On the other hand, it is possible that the machine of the general kind of FIG. 1 is destined for the use with prolonged series of cartons of the same width, then substituted with new series of cartons of constant width too, but different from the first one. In such case it is clearly useless to execute every time an approaching and removal movement of the conveying units, as it is in the case of the variable-width cartons. On the contrary it is sufficient to have the possibility to fix the conveying units in a determined position, which will be maintained for all the series of cartons of the same lenght and changed only before the beginning of the work on the successive series.

Figure 5:
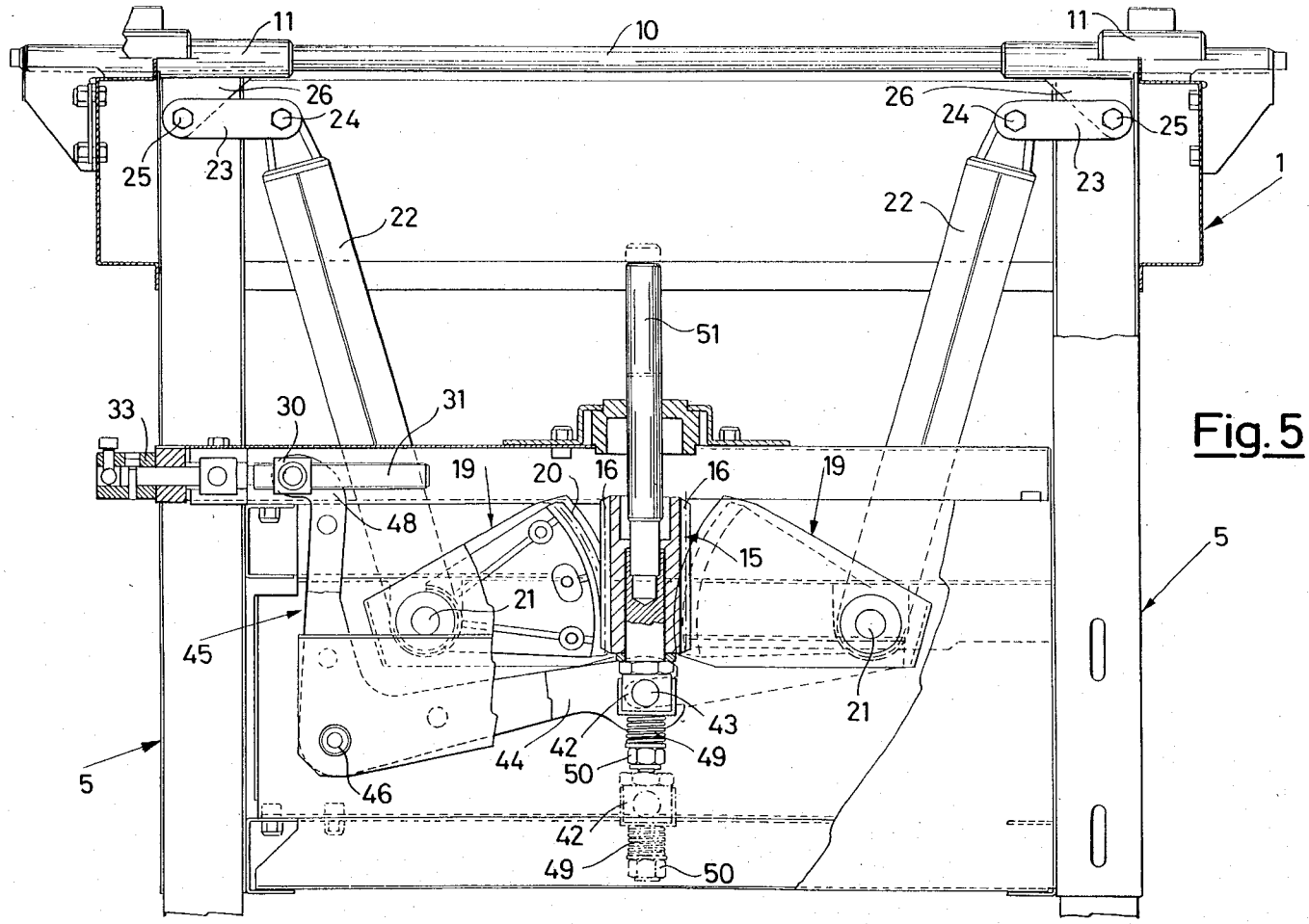
FIG. 5 shows a different control device according to the invention, included in a sealing machine for the constant width cartons, said machine being sectioned along a transversal plane substantially equal to that of FIG. 2, but looking at in opposite direction.

Being unchanged the general constructive concept of the sealing machine, it is then provided to replace the control device of FIG. 2 with that of FIG. 5, which differs from the previous one in the fact that, the pneumatic cylinder 18 having been removed, the rack plunger 15 is fixed to a vertical sliding stem 51, on which there is also slidingly mounted a control nut 42, from which laterally project pins 43 kept in bidirectional engagement by a forked end 44 of a squared lever 45 pivoted in 46 on a fixed bracket 47. The other end 48 of the same lever takes then, similarly to the end 34 of the lever 27 of FIG. 2, a female thread 30 engaged on a threaded shaft 31 slidingly supported in its turn by the fixed frame of the machine and operable in rotation by means of a crank (not illustrated) coupled to a driving block 33. A spring 49 is interposed between the sliding nut 42 and a nut 50 screwed on a threaded end of the sliding stem 51 to elastically stress the rack plunger 15 against the control nut 42.

It is evident that the position of the rack plunger 15 and therefore, through the sector gears 19, the arms 22 and the connecting rod 23, that of the conveying unit 3 depend on the position of the control nut 42, in its turn hand-controlled by means of the threaded shaft 31 and the squared lever 45. Through the rotation of the crank fixed to the driving block 33 it is thus possible to fix in an adjustable way the mutual position of the conveying units, destined to reamin unchanged for a complete series of cartons of the same width and then to be changed before the use on a new series of varied width cartons.

It is to be noted that the work distance fixed for the conveying units will be slightly smaller that the carton width, so as to allow the spring 49 to give the rack plunger 15 and therefore the conveying units, the work pressure necessary for the conveying engagement with the cartons. Substantially, the spring 49 resists the movement of the plunger 15 in the sense corresponding to the removal movement of the conveying units, which is caused by the forced fitting of the cartons, and so it creates said work pressure.

I claim:

1. Device for the control of the mutual removal and approaching movement of lateral conveying units in a carton sealing and/or closing machine of the kind including a carton support base and, along two opposite sides thereof, a pair of conveying units slidingly mounted on fixed transversal guides of the base so as to be approachable each other to realize a conveying engagement with the carton sides and then movable away from each other for the return to rest position, characterized in that it comprises a rectilinearly sliding plunger with rack-shaped opposite sides, control means of the sliding of said plunger, a pair of rotating sector gears in engagement with said rack sides of said plunger to transform the rectilinear sliding of the same plunger into opposite corresponding rotations of said sector gears, a pair of arms extending from said sector gears up to the proximity of said conveying units and integrally rotating with the same gears, and a pair of connecting rods connected to said arms and said conveying units to transform the rotating movement of said arm into a corresponding translatory motion of said conveying units in opposite senses along said guides.

2. Device according to claim 1, characterized in that said control means are constituted by a fluid-dynamic cylinder, on the piston stem of which said sliding plunger is fixed.

3. Device according to claim 2, characterized in that it comprises adjustable means interacting with said plunger for the delimitation of its stroke in the sense corresponding to the mutual removal of said conveying units.

4. Device according to claim 3, characterized in that said adjustable means are constituted by a hand-operation lever, a part of which is unidirectionally engageable by a pin integral with said plunger at the end of said stroke defined by the same plunger.

5. Device according to claim 4, characterized in that said lever is operated through the rotation of a threaded shaft engaged with a female thread fixed to said lever.

6. Device according to claim 1, characterized in that said plunger is mounted on a sliding stem and said control means are constituted by a hand-operation lever, a part of which is in bidirectional engagement with a nut in its turn slidingly mounted on said stem, elastical means which stress said plunger against said nut in the sense corresponding to the mutual approaching of said conveying units being provided.

7. Device according to claim 6, characterized in that said lever is operated through rotation of a threaded shaft engaged with a female thread fixed to said lever.

8. Device according to claim 1, characterized in that said connecting rods provide a succession of pivot holes for said arms and said conveying units, said holes being alternatively chosen to correspondingly change the distance among the points of pivotment with said arms and said conveying units.

* * * * *